US005544843A

United States Patent [19]

Johnson

[11] Patent Number: 5,544,843

[45] Date of Patent: Aug. 13, 1996

[54] BALLISTIC MISSILE REMOTE TARGETING SYSTEM AND METHOD

[75] Inventor: William M. Johnson, Sudbury, Mass.

[73] Assignee: The Charles Stark Draper Laboratory, Inc., Cambridge, Mass.

[21] Appl. No.: 749,652

[22] Filed: Aug. 1, 1991

[51] Int. Cl.[6] ..... F41G 7/30

[52] U.S. Cl. ..... 244/3.11

[58] Field of Search ..... 244/3.11, 3.13

[56] References Cited

U.S. PATENT DOCUMENTS

| | | | |
|---|---|---|---|
| 3,073,550 | 1/1963 | Young | 244/3.11 |
| 4,003,659 | 1/1977 | Conard et al. | 244/3.11 |
| 4,571,076 | 2/1986 | Johnson | 356/152 |
| 4,776,691 | 10/1988 | Johnson et al. | 356/152 |
| 4,910,596 | 3/1990 | Kieft | 358/160 |
| 5,056,740 | 10/1991 | Roth et al. | 244/3.13 |

*Primary Examiner*—Charles T. Jordan
*Attorney, Agent, or Firm*—Weingarten, Schurgin, Gagnebin & Hayes

[57] ABSTRACT

A space-based command guidance controller and controlled deliverable traveling at speeds of about Mach five are cooperative to cause the deliverable to follow a coherent designator beam controlled by the space-based command guidance controller to be delivered to a target location, eventually designated by the beam along an over-the-horizon trajectory, and into a target thereat with surgical-like precision. The command guidance controller includes an optical tracker and coherent designator laser assembly and an inertially-stabilized tracker that are cooperative to produce a command guidance signal representative of that controlled deliverable maneuver that enables the controlled deliverable, upon the execution thereof, to conform its trajectory to the intended trajectory, and eventually, to impact the intended target. The controlled deliverable includes an autopilot that executes the maneuver represented by the command guidance signal in order to bring the controlled deliverable into local conformance to the intended trajectory. The controlled deliverable includes an optical roll sensor having a negligible scale-factor-error. The intended target location may include a static and/or a dynamic target object.

54 Claims, 8 Drawing Sheets

BALLISTIC MISSILE REMOTE TARGETING SYSTEM AND METHOD

FIELD OF THE INVENTION

This invention is directed to the field of remote targeting, and more particularly, to a ballistic missile remote targeting system and method.

BACKGROUND OF THE INVENTION

The field of remote targeting is dividable into subfields corresponding to the type of controlled deliverable to be guided. Command guidance has been associated with the problem of remotely guiding comparatively high-speed deliverables, such as the warhead of a ballistic missile traveling at a speed of about Mach five, and homing guidance has been associated with the problem of guiding comparatively low-speed deliverables by on-board controllers, such as jet powered and rocket propelled deliverables traveling at speeds less than about Mach one or Mach two, to target objects. The heretofore known command guidance systems, which typically provide an over-the-horizon targeting capability, have generally been based on inertial guidance subsystems deployed on-board the deliverables, and, as such, have been "blind" in that they were not provided with and did not respond to any feedback information in real-time representative of the actual target itself. The heretofore known homing guidance systems, which typically provide a line-of-sight targeting capability, have deployed various feedback control subsystems that have responded to a predetermined characteristic associated with the target, such as a laser designator spot or an infrared signature, to close a homing control loop in such a way as to cause the deliverable to be delivered to the target object. The heretofore known homing guidance systems in the first place have been limited to deliverables traveling at speeds less than about Mach one or Mach two, and have been generally unable to provide homing guidance of deliverables traveling at speeds of about Mach five characteristic of the command guidance control regime. In the second place, they have been limited to a line-of-sight targeting capability, and have been generally unable to provide homing guidance of deliverables to over-the-horizon target locations.

SUMMARY OF THE INVENTION

The present invention discloses as its principal object a space-based command guidance controller and a controlled deliverable traveling at speeds of about Mach five that are cooperative to cause the deliverable to follow a coherent designator beam controlled by the space-based command guidance controller towards a target location designated by the beam along an over-the-horizon trajectory. In accord therewith, space-based command guidance controller first means are disclosed for controllably pointing a coherent designator beam along an optical path defined with respect to inertial space. The beam path may be intended to illuminate the controlled deliverable and/or the intended target location. The target location may include static and/or dynamic targets. In further accord therewith, space-based command guidance controller second means cooperative with the first means and responsive to optical energy present along the reciprocal optical path of the coherent designator beam are disclosed for providing a first signal representative of where the controlled deliverable is with respect to the optical path of the coherent designator beam and a second signal representative of the actual target. In further accord therewith, space-based command guidance controller third means cooperative with the first and second means and modally responsive to the first signal representative of where the controlled deliverable is with respect to the optical path of the coherent designator beam and modally responsive to the second signal representative of the actual target are disclosed for providing a command guidance signal representative of what maneuver the controlled deliverable needs to execute to hit the target impact point; in one mode, the third means is responsive only to the first signal, and in another mode to both the first and the second signals, to provide the command guidance signal. In further accord therewith, controlled deliverable fourth means are disclosed for providing a signal representative of the real-time attitude of the controlled deliverable in pitch, in yaw and in roll. In further accord therewith, controlled deliverable fifth means cooperative with the fourth means and responsive to the signal representative of the real-time attitude of the controlled deliverable in pitch, roll and yaw and responsive to the command guidance signal are disclosed for executing the command guidance signal at that precise aspect in pitch, roll and yaw that causes the controlled deliverable to conform its trajectory to the beam path of the coherent designator beam and thereby to deliver itself to the target location with surgical-like precision. In the preferred embodiment, the first and second cooperative means of the space-based command guidance controller include a coherent designator laser, an inertially-stabilized tracker having a wide field of regard star tracker and an optical tracker having a steerable field of view. The inertially-stabilized tracker includes means such as gyros for calculating the position of the space-based command guidance controller with respect to inertial space, and a processor responsive to the calculated position and/or to the second signal for calculating the pointing direction of the coherent designator laser to cause the controlled deliverable to follow its intended trajectory to the target location. In the preferred embodiment the gyros are subject to errors due to the phenomenon of gyro drift, and the wide field of regard star tracker is cooperative with the processor to compensate the gyros for drift. In an alternative embodiment, the processor of the space-based command guidance controller may periodically so rotate the optical tracker that its field of view is caused to fix on the stars to update the gyros in lieu of the wide field of regard star tracker.

In the preferred embodiment, a reflector is mounted to the controlled deliverable by means of which the coherent designator beam is reflected back to the inertially-stabilized tracker to provide the first signal representative of where the controlled deliverable is with respect to the optical path of the coherent designator beam.

In the preferred embodiment, the inertially-stabilized tracker includes a high-bandwidth mosaic array sensor having a multiplespot tracking capability, and both the first signal representative of where the controlled deliverable is with respect to the optical path of the coherent designator laser and the second signal representative of actual target location preferably are constituted as spots on the high-bandwidth mosaic array sensor. Means coupled to the sensor are disclosed for compensating the first signal representative of where the controlled deliverable is with respect to the optical path of the coherent designator laser and the second signal representative of actual target location for space and other sources of noise vibration to which the inertially-stabilized tracker is subjected. The noise compensation means includes a platform at rest with respect to inertial space, preferably a magnetically suspended platform defining an axis. The axis of the platform is maintained parallel to the pointing direction of the steerable field of view of the optical tracker.

In the preferred embodiment, the optical tracker having a steerable field of view includes a beam expander having a magnified region and a compressed region. The compressed region of the beam expander is coupled to the inertially-stabilized tracker, and the expanded region of the beam expander is coupled to optics providing a steerable field of view. In one embodiment, the designator laser is positioned in the compressed region of the beam expander, in another embodiment in the magnified region of the beam expander, while in a further embodiment the designator laser is located remotely to the spaced-based command guidance controller and is relayed thereto via a reflector operatively associated with the space-based command guidance controller. The beam expander and compressor provides a preselected magnification factor that both enhances the positional resolution of spots on the high-bandwidth mosaic array sensor having a multiple-spot tracking capability as well as minimizes the spread of the coherent designator beam in the embodiment where the coherent designator laser is positioned in the compressed region of the beam expander. In each of the designator laser embodiments, the noise compensated star updated inertially-stabilized tracker enables the coherent designator beam to be at a desirably low power, one tenth to one watt by way of example. In one embodiment the optics of the optical tracker providing a steerable field of view includes a two degree of freedom specular member under control of the processor of the inertially-stabilized tracker, and in another embodiment it includes two confronting and spaced apart specular members rotatable about mutually orthogonal axes under control of the processor of the inertially-stabilized tracker.

In the preferred embodiment, the space-based command guidance controller third means includes a telemetry channel between the processor of the inertially-stabilized tracker and the controlled deliverable. In one embodiment, the command guidance signal representative of what maneuver the controlled deliverable needs to execute to conform its trajectory to the optical path of the coherent designator beam is modulated on the coherent designator beam and in another embodiment the command guidance signal is separately transmitted by any suitable electromagnetic or other transmitter operatively associated with the space-based command guidance controller.

In the preferred embodiment, the controlled deliverable fourth means includes pitch and yaw inertial sensors mounted to the controlled deliverable respectively providing signals representative of the real-time attitude of the controlled deliverable in pitch and in yaw, and an optical sensor and associated optics disposed on the controlled deliverable responsive to the coherent designator beam to focus the same as an optical spot on the sensor that moves on the sensor in accord with the rolling motion of the controlled deliverable providing thereby a signal representative of the real-time attitude of the controlled deliverable in roll. The optical roll sensor exhibits a negligible scale-factor-error.

In the preferred embodiment, the controlled deliverable fifth means includes an autopilot and autopilot controlled servos responsive to the command guidance signal and to the signals representative of the real-time attitude of the controlled deliverable in pitch, roll and in yaw to so activate the servos in dependence on the real-time attitude of the controlled deliverable as to cause it to execute the command guidance signal.

In one operational mode, the space-based command guidance controller of the invention oversees the delivery of the controlled deliverable to the intended target from launch to impact. In another operational mode, the space-based command guidance controller of the invention oversees the delivery of the controlled deliverable upon control transfer thereto once the controlled deliverable climbs into space through the atmosphere under internal inertial subsystem control. In a further operational mode, the space-based command guidance controller hands control of the controlled deliverable over to a homing guidance controller onboard the controlled deliverable in the final phase of delivery immediately before impact with the target location. In the latter mode, the designator laser may so illuminate the target location as to provide a homing control spot for the homing guidance controller on-board the controlled deliverable. During its short final phase, either optical or gyro roll sensing can be alternatively implemented if cloud-cover is a problem.

BRIEF DESCRIPTION OF THE DRAWINGS

Other objects, aspects and features of the present invention will become apparent as the invention becomes better understood by reference to the following detailed description of the preferred embodiments thereof and to the drawings, wherein.

DETAILED DESCRIPTION OF THE PREFERRED EMBODIMENTS

Figure 1A:
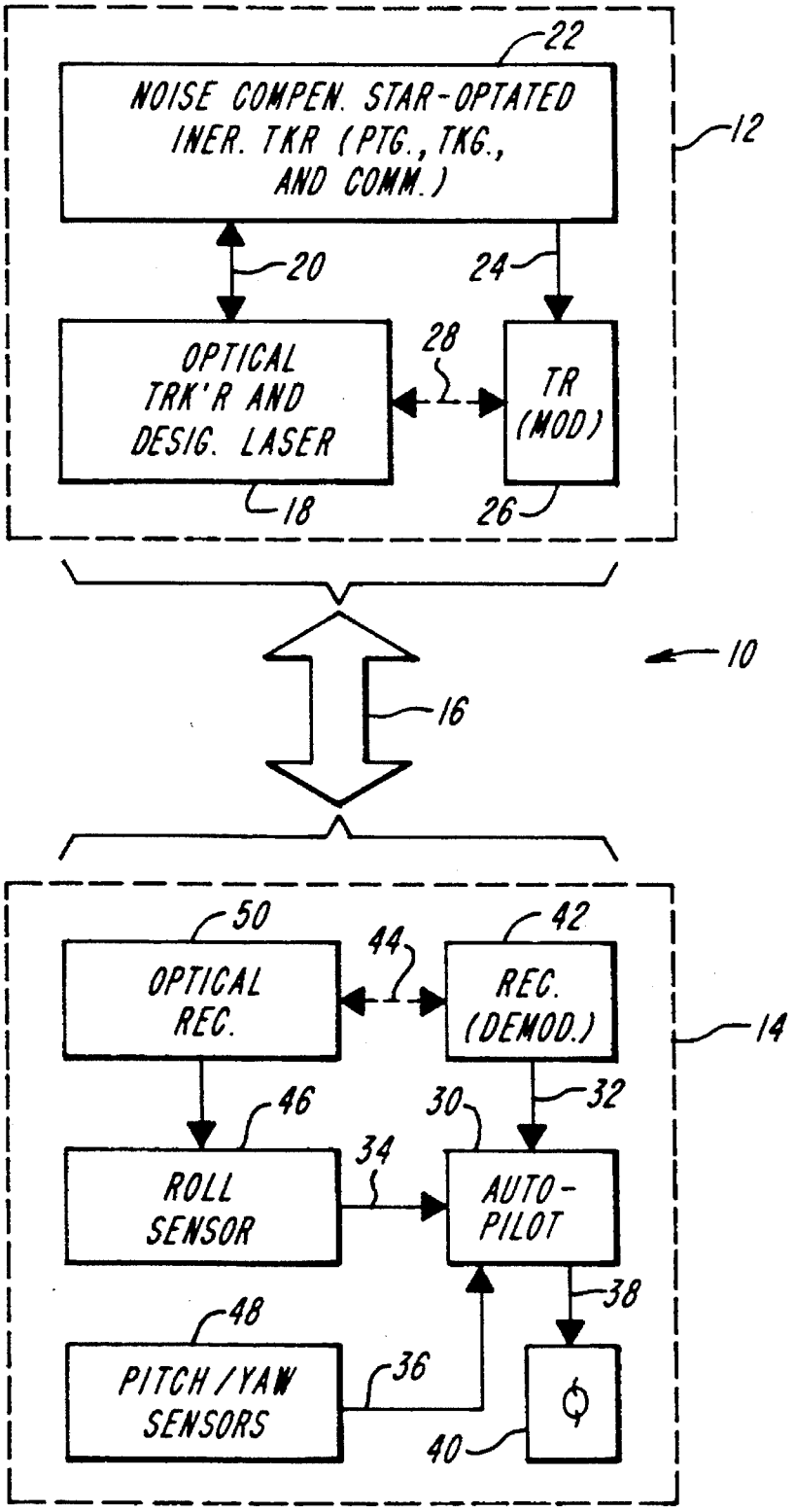
FIG. 1 illustrates in the FIG. 1A thereof a block diagram and in the FIG. 1B thereof a pictograph that are useful in explaining the ballistic missile remote targeting system and method of the present invention.

Referring now to FIG. 1A, generally designated at 10 is a block diagram useful in explaining the ballistic missile remote targeting system and method in accord with the present invention. A command guidance controller is schematically illustrated by a dashed box 12, a controlled deliverable is illustrated by a dashed box 14, and a communication channel therebetween is illustrated by double headed arrow 16. The command guidance controller is space-based, and may be deployed on-board one or more satellites orbiting the earth at an altitude of about two hundred (200) to five hundred (500) miles, and the controlled deliverable is a ballistic missile capable of over-the-horizon targeting and delivery.

The command guidance controller 12 includes an optical tracker and coherent designator laser assembly 18 optically coupled as illustrated by arrow 20 to an inertially-stabilized tracker 22. The inertially-stabilized tracker 22 controls the optical tracker 18 in such a way that the field of view of the optical tracker 18 is steered in a tracking mode to always point in directions that track the movement of the controlled deliverable 14 and in a target boresight mode to point in a direction that sights the intended target location. With the controlled deliverable 14 always in the field of view of the optical tracker 18 in the tracking mode, the inertially-stabilized tracker 22 controls the coherent designator laser of the optical tracker and coherent designator laser assembly 18 in such a way that the coherent designator laser is pointed along a beam path defined with respect to inertial space that corresponds to the trajectory that the controlled deliverable should follow towards the target location. The intended trajectory is defined by information representative of where the space-based platform, controlled deliverable and actual target are in relation to one another. In one operational mode where the target is stationary or otherwise known to a high precision, the inertially-stabilized tracker 22 in the tracking mode is responsive via the link 20 to optical energy present within the field of view of the optical tracker and coherent designator laser assembly 18 representative of any deviation of the trajectory of the controlled deliverable 14 off the intended trajectory as defined by the coherent designator laser beam path and is operative to produce a command guidance signal illustrated by an arrow 24 representative of that controlled deliverable maneuver that enables the controlled deliverable 14, upon the execution thereof, to conform its trajectory to the intended trajectory as defined by the beam path of the coherent designator laser. In another operational mode where the target is mobile or otherwise unknown, the inertially-stabilized tracker in the target boresight mode is responsive to optical energy returned from the actual target location by deviation of the designator laser thereoff to calculate the space-time coordinates of the target itself, and is operative in response to both the deviation of the controlled deliverable off intended trajectory and to the actual target location to provide a command guidance signal that, upon execution by the controlled deliverable, causes the same to be delivered to the target with surgical-like precision.

In one embodiment, a transmitter 26, such as a radio or optical link or other transmitter, is provided to transmit the command guidance signal 24 over the communication channel 16 to the controlled deliverable 14, and in another embodiment, the transmitter 26 may include a modulator, operatively coupled to the optical tracker and coherent designator laser assembly 18 as schematically illustrated by dashed line 28, that modulates the coherent designator laser with the command guidance signal 24.

The controlled deliverable 14 includes an autopilot 30 that executes the maneuver represented by the command guidance signal in order to bring the controlled deliverable 14 into local conformance to the trajectory established therefor by the beam path of the coherent designator laser. The autopilot 30 is responsive to the command guidance signal 24 representative of what maneuver it should execute as illustrated by a line 32 and is responsive to signals illustrated by lines 34 and 36 to be described representative of the real-time attitude of the controlled deliverable 14 in roll, and in pitch/yaw, to provide an output control signal 38. The output control signal 38 is applied to on-board servos 40 that so execute the command guidance signal, given the real-time attitude in pitch, in yaw and in roll of the deliverable, as to maintain the controlled deliverable 14 dynamically on course along the optical path defined by the coherent designator laser towards, and finally into, the target location. The servos 40 may be aerodynamic control surfaces, selectively displaceable steering weights, and gas jets, among others, well-known to those skilled in the art.

On-board the controlled deliverable the command guidance signal 32 representative of what maneuver the controlled deliverable should execute to be where the controlled deliverable 14 should be at any point locally along the trajectory specified therefor by the optical path of the coherent designator laser is output by a receiver 42, which may be a radio receiver of the same frequency as that of the transmitter 26 in the embodiment where a transmitter 26 is employed, and which may be a demodulator responsive to the modulated beam of the coherent designator laser in the embodiment where the command guidance signal is modulated on the coherent designator laser beam. In the former embodiment the receiver 42 receives the command guidance signal directly over the link 16, while in the latter embodiment it receives the command guidance signal indirectly from the coherent designator beam via an on-board optical receiver 50 as schematically illustrated by double-headed dashed arrow 44.

In the preferred embodiment, the signals 34, 36 representative of the attitude of the controlled deliverable 12 in roll and in pitch/yaw are respectively implemented by an optical sensor 46 to be described that has a negligible scale-factor error and by conventional pitch/yaw sensors 48 such as a pitch gyro and a yaw gyro. As appears more fully hereinbelow, the roll sensor 46 includes the optical receiver 50 and cooperative optics to be described that respond to the coherent designator beam illuminating the controlled deliverable to provide the substantially scale-factor-error-free signal 34 representative of the roll of the controlled deliverable 14 in real-time. An on-board roll gyro of convention design, not shown, may be employed whenever cloud-cover or other factors obscure the designator beam.

Figure 1B:
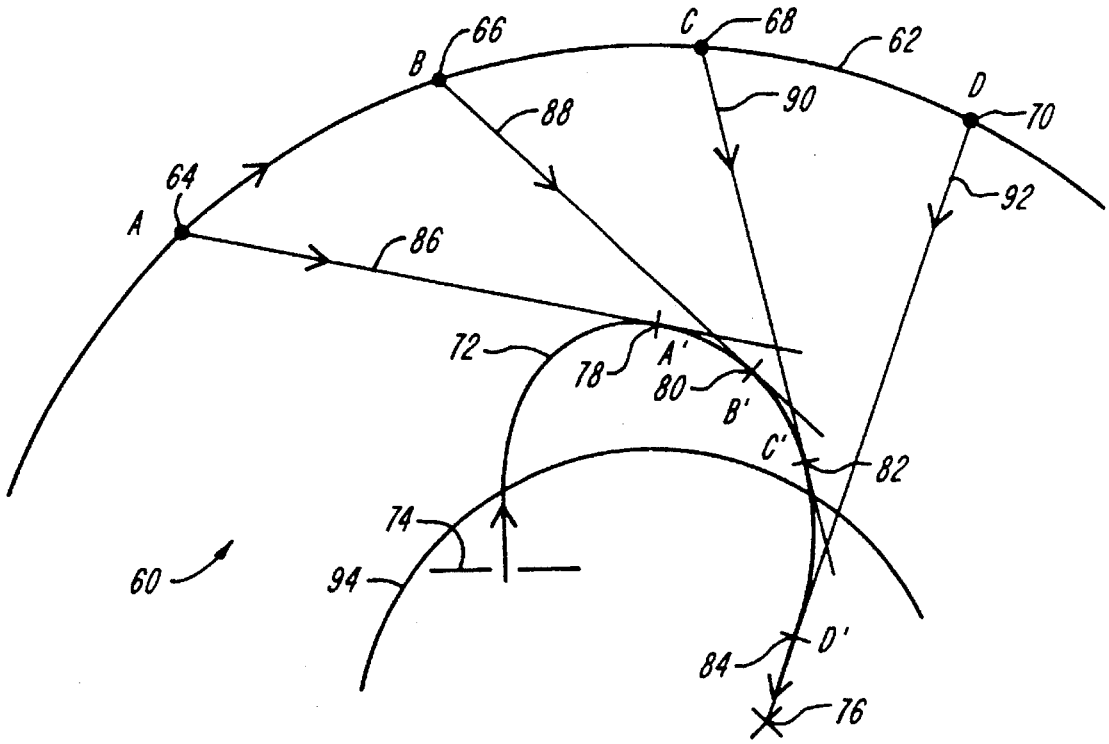

Referring now to FIG 1B, generally designated at 60 is a schematic diagram illustrating the manner by which the ballistic missile remote targeting system and method of the present invention enables to deliver a controlled deliverable traveling at speeds of about Mach five towards and to a target location along an over-the-horizon trajectory. A first trajectory illustrated by an arc 62 represents the motion of the space-based command guidance controller 12 (FIG. 1A) as it moves in orbit. Points 64, 66, 68, and 70 respectively marked "A", "B", "C" and "D" designate definite exemplary phases of the motion of the space-based command guidance controller 12 (FIG. 1A) as illustrated by the arc 62. An arc 72 represents the trajectory of the controlled deliverable 14 (FIG. 1A) defined from a launch vehicle, schematically illustrated by broken line 74, to a target 76, designated by a "X" that is remote from the launch platform 74. By way of example, the launch platform 74 may be an underwater platform, and the target 76 may be an over-the-horizon target location of strategic and/or of tactical importance Ticks 78 designated "A'", 80 designated "B'", 82 designated "C'", and 84 designated "D'" illustrate definite phases along the trajectory 72 of the controlled deliverable that respectively correspond to the exemplary phases 64, 66, 68, 70 along the trajectory 62 of the space-based command guidance controller 12.

In accord with the present invention, as exemplified by the phases A, A', B, B', C, C', and D, D' the command guidance controller is always operative to point the coherent designator laser in that direction with respect to inertial space that intercepts the local trajectory of the controlled deliverable and defines for the controlled deliverable the path to follow to and towards the target 76 as schematically illustrated by the temporally successive line segments 86, 88, 90 and 92. The trajectory may be calculated from information representative of the location of the space-based platform, controlled deliverable and target location relative to each other including information representative of the actual positions of the controlled deliverable as well as of the target location as provided by the designator laser beam being respectively reflected back therefrom.

In the exemplary diagram 60, an arc 94 represents the atmosphere. The controlled deliverable's trajectory 72 includes a first atmospheric leg during which it climbs out of the atmosphere after launch from the platform 74 under control of an on-board inertial guidance subsystem, a space-leg at some point along which it is first subject to command guidance control by the space-based command guidance controller as illustrated by the three phases A, A', B, B', and C, C', and a second atmospheric leg upon re-entry of the controlled deliverable back into the atmosphere as illustrated by the atmospheric phase D, D'. During the second atmospheric leg, and as appears more fully hereinbelow, the designator laser in the target boresight mode is pointed by the space-based command guidance controller directly at the intended target location. Optical energy is returned therefrom and the image of the intended target location is displayed on-board the space-based command guidance controller. The command guidance signal provided by the command guidance controller locks the controlled deliverable trajectory to the intended target location modally in response to the image thereof displayed on-board the space-based command guidance controller and in response to the image of the controlled deliverable; in one mode it is operative to provide the command guidance signal in response to the image of the controlled deliverable and in another mode to both the image of the controlled deliverable and to the image of the actual target location.

During both the first atmospheric leg and the space leg the controlled deliverable is comparatively well-behaved. However, the controlled deliverable exhibits a comparatively poorly-behaved motion during the second atmospheric leg of its trajectory towards the target 76, when the controlled deliverable, typically traveling at about Mach five, both spins as it descends in a vertical pattern and is asymmetrically accelerated by forces produced as its nose non-uniformly ablates by the heat generated during atmospheric re-entry. During the second atmospheric re-entry leg schematically illustrated by the segment 92 marked D, D', the substantially scale-factor-error-free roll sensor 46 and the pitch/yaw sensors 48 (FIG. 1A) provide the signals 34, 36 (FIG. 1A) that are representative of the real-time attitude of the controlled deliverable that enable the autopilot 30 (FIG. 1A) to so actuate the servos 40 (FIG. 1A) as to precisely cause the controlled deliverable to follow the beam path of the coherent designator laser towards and to the target 76 with a high degree of precision notwithstanding that the motion of the controlled deliverable is comparatively poorly-behaved during the second atmospheric re-entry leg.

Figure 2A:
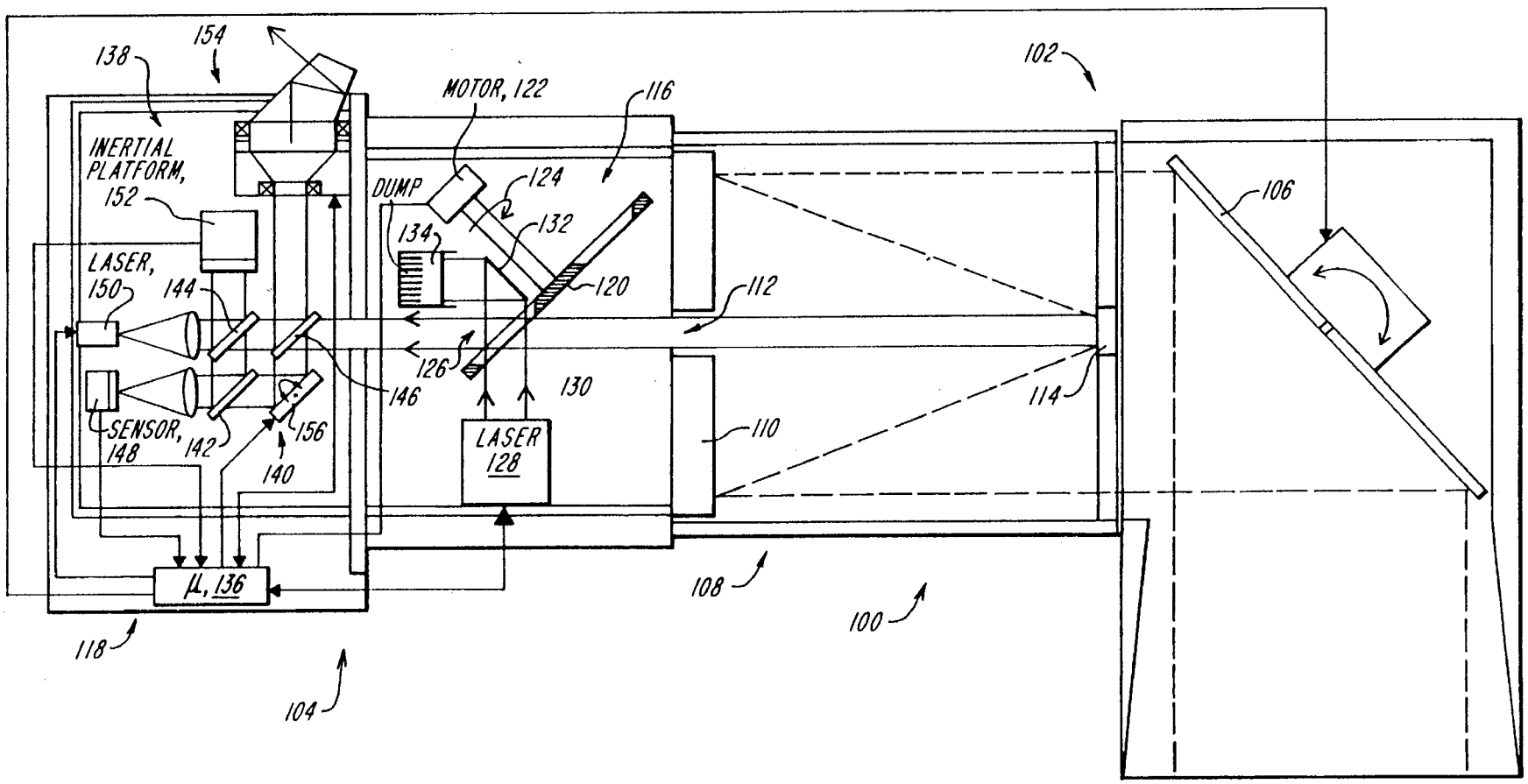
FIG. 2 illustrates partially sectional, partially schematic diagrams in the FIGS. 2A, 2B and 2C thereof showing different embodiments of a space-based command guidance controller in accord with the ballistic missile remote targeting system and method of the present invention.

Referring now to FIG. 2A, generally designated at 100 is a schematic diagram illustrating one embodiment of the space-based command guidance controller in accord with the ballistic missile remote targeting system and method of the present invention. The controller 100 includes an optical tracker generally designated 102 providing a steerable field of view in which outgoing and return energy are received along a common optical path, and an inertially-stabilized tracker and coherent designator laser assembly generally designated 104 for generating a command guidance signal to be described in response to optical energy received within and along the beam path of the field of view of the tracker 102. The optical energy may be the energy returned by the controlled deliverable in response to its being illuminated by the optical energy of the designator beam and/or may be the energy returned by a target at the target location in response to its being illuminated thereby. The target at the target location may be either at rest or in motion without departing from the inventive concept.

The optical tracker 102 includes a two-degree of freedom mirror 106 defining a steerable field of view, and a beam expander generally designated 108 having a magnified region and a compressed region optically coupled to the two-degree of freedom reflector 106 in the magnified portion of the expander 108. The expander 108 includes a comparatively-large primary reflector 110 having a central aperture thereinthrough generally designated 112, and a spaced-apart comparatively smaller diameter secondary reflector 114 aligned with the aperture 112 of the primary reflector 110 along the optical axis of the beam expander 108.

The inertially-stabilized tracker and coherent designator laser assembly 104 includes a common optical aperture laser separator generally designated 116 with its optical aperture optically coupled along the optical axis of the beam expander and compressor 108, and an inertially-stabilized tracker generally designated 118 optically coupled to the optical aperture of the common optical aperture laser separator 116.

The laser separator 116 preferably includes an apertured spinning mirror 120, rotatably driven by a motor 122, as indicated by arrow 124, that is positioned at an angle to the optical axis of the beam expander 108. The optical aperture of the spinning mirror 120 is generally designated at 126, and a coherent designator laser 128 produces an output beam of coherent energy 130 along an optical path that intercepts the optical aperture 126 of the laser separator 116. At times synchronous with the coincidence of the reflecting portion of the spinning mirror 120 with the optical aperture 126, the designator laser beam 130 is deviated thereoff and along the optical axis of the beam expander and compressor 108, whereby it is incident to the steering mirror 106 in the expanded regime of the beam expander and compressor 108. The mirror 106, in turn, deviates it under control of the inertially-stabilized tracker 118 in that direction intended to define the local trajectory of the controlled deliverable towards and to the intended target direction. During operation in the boresight mode, the designator beam may be deviated by the mirror 106 under control of the inertially-stabilized tracker 118 to cause it to illuminate the target location itself. At times synchronous with the coincidence of the one or more apertures of the apertured spinning mirror 120 with the optical aperture 126 of the separator 116, the designator laser beam, if operated in a CW mode, is deviated off a reflector 132 into a power dump 134. Reference may be had to commonly assigned, allowed United States utility patent application Ser. No. 512,150, filed Jul. 8, 1983 and entitled: COMMON OPTICAL APERTURE LASER BORESIGHTER FOR RECIPROCAL PATH OPTICAL SYSTEMS of the same inventive entity as herein, incorporated herein by reference, for a further description of the laser separator 116, as well as for a description of alternative laser separators such as the spacial and spectral laser separators referred to therein, that may as well be employed without departing from the inventive concept.

The inertially-stabilized tracker 118 includes a processor 136 and an inertially-stabilized, star-updated tracker having a multiple-spot tracking capability generally designated 138. The tracker 138 includes a monolithic optical assembly generally designated 140 having beam splitting elements 142, 144 and 146 optically coupled to the optical aperture of the laser separator 116. A high-bandwidth mosaic array sensor 148 having a multi-spot tracking capability is optically coupled to the monolithic optics 140 via the beam splitter 142 thereof. The beam expander and compressor 108, among other advantages, provides a selected magnification factor to incoming optical energy received within the field of view of the optical tracker 102. The magnification factor enables the mosaic sensor 148 of the inertially-stabilized tracker 118 to provide high resolution spot position determinations. Reference may be had in this connection to commonly assigned, allowed United States utility patent application Ser. No. 927,266, of the same inventive entity as herein and incorporated herein by reference, filed Nov. 4, 1986 and entitled: BALLISTIC MISSILE BORESIGHT AND INERTIAL TRACKING SYSTEM AND METHOD, for a description, among others, of the effect of the magnification factor on the sensor positional resolution determinations which application has now been abandoned and its subject matter incorporated into allowed, co-pending U.S. utility patent application Ser. No. 517,147, of the same title, filed May 1, 1990, incorporated herein by reference.

An alignment laser 150 is optically coupled to the monolithic optics 140 via the beam splitters 144 and 146 thereof. An inertial platform 152 is optically coupled to the monolithic optics 140 via the elements 144 and 142 thereof, and a wide field of regard star monitor generally designated 154 is optically coupled to the monolithic optics 140 via the element 146 thereof.

The processor 136 is connected by control lines, as illustrated, to the actuator of the two degree of freedom mirror 106 of the optical tracker 102, to the motor 122 of the laser separator 116 of the inertially-stabilized tracker and coherent designator laser assembly 104, to the designator laser 128, to the mosaic array sensor 148, to the alignment laser 150, to the inertial platform 152, to the wide field of regard star tracker 154 and to the two degree of freedom actuator of the specular member 156 of the inertially-stabilized tracker 138 of the command guidance controller 104.

The inertial platform 152 has a member at rest with respect to inertial space, such as a magnetically suspended platform. The platform has a mirrored reference axis along the direction of its optical axis, and in the preferred embodiment, the optical axis is aligned to be generally parallel to the pointing direction of the optical tracker 112. A two degree of freedom reflector 156 is provided confronting the splitters 142, 146 of the monolithic optics 140. The tracker 138 is preferably of the type disclosed and claimed in the above-identified and incorporated cognate allowed U.S. utility patent application which application has been abandoned and its subject matter incorporated into allowed, co-pending U.S. utility patent application Ser. No. 517,147, entitled: BALLISTIC MISSILE BORESIGHT AND INERTIAL TRACKING SYSTEM AND METHOD, filed May 1, 1990, of the same inventive entity as herein.

The signal representative of where the controlled deliverable is and the signal representative of the actual target are preferably in form of optical spots imaged on the mosaic array sensor. The processor 136, the inertial platform 152 and the alignment laser 150 are cooperative with the monolithic optics 140 and the two degree of freedom reflector 156 to stabilize the position of such spots on the optical array 148 and thereby to compensate the spot resolution capability of the tracker 138 against space noise and other sources of vibration. Any drift to which the member at rest with respect to inertial space is subject is periodically measured by the star monitor 154, and the drift or other error is compensated by the processor 136 of the inertially-stabilized tracker 118. While it is preferred to use the star monitor to enable the processor 136 to compensate for any drift of the inertial platform 152, the command guidance controller 100 may be rotated as a whole, as, for example, by rocket thrusters, not shown, to enable the optical tracker 102 to sight the fixed stars in lieu of the star monitor 154 and thereby obtain the reference by which the drift or other error of the inertially-stabilized member is compensable.

For the embodiment 100 of the FIG. 2A embodiment, the manner of operation of the inertially-stabilized tracker 138 by which it provides high-bandwidth, low-amplitude noise compensation is fully and adequately described in the above-identified and incorporated cognate allowed United States utility patent application. The alignment laser 150 cooperates with the monolithic optics 140 and inertial platform 152 to provide a pseudo-star spot on the high-bandwidth mosaic array sensor 148. The motion of the pseudo-star spot corresponds to noise-induced-motion of the tracker 138. The processor 136 is responsive to motion of the pseudo-star spot to so drive the two degree of freedom specular member 156 as to stabilize the controlled deliverable spot on the mosaic array sensor. Therewith, the processor 136 provides high-bandwidth, low-amplitude noise compensation for all the spots imaged on the sensor 148, including the target spot.

The manner of operation of the inertially-stabilized tracker 138 by which it tracks the controlled deliverable is fully and adequately described in the above-identified and allowed cognate United States utility patent application. The image of the controlled deliverable is focused as a spot on the mosaic array sensor 148. As the controlled deliverable moves, the spot corresponding thereto on the mosaic array sensor is moved. The processor 136 of the inertially-stabilized tracker closes a control loop to cause the image of the controlled deliverable on the mosaic array sensor to remain at rest by causing the field-of-view of the optical tracker 102 to track the controlled deliverable along its trajectory. The processor 136 of the inertially-stabilized tracker responds, in addition, to the image of the target location, whether mobile or stationary, to close a control loop to cause the controlled deliverable to zero-in on the intended target location. The image of the target location is in the form of optical energy returned therefrom by deviation thereoff of the designator laser of the space-based command guidance controller, which is imaged as a spot on the mosaic array sensor.

The mosaic sensor 148 of the tracker 138 is preferably of the type disclosed and claimed in commonly-assigned U.S. Pat. No. 4,910,596, entitled: HIGH BANDWIDTH PLURAL SPOT VIDEO PROCESSOR, incorporated herein by reference. As appears more fully therein, the sensor 148 is capable of resolving multiple spots of optical energy at a three kilohertz bandwidth and with a very high positional accuracy. The manner of operation of the sensor in achieving a high-bandwidth, high-resolution and multiple-spot tracking capability is fully and completely described in the cognate United States Patent and is not again described herein for the sake of brevity of explication.

To provide tracking and command guidance of the space-time position of the controlled deliverable and in the first operational mode where the target is at rest or otherwise known with precision, the processor 136 is operative: (1) to controllably steer the field of view of the tracker 102 such that the controlled deliverable is always maintained in its field of view, (2) to activate the designator laser 128 and steering mirrors of the optical tracker 102 and concomitantly to so synchronize the laser separator 116 that the optical path of the designator laser within the field of view of the optical tracker defines the space-time trajectory with respect to inertial space that the controlled deliverable is to follow to its intended target location, (3) to synchronize the laser separator to allow return energy present along the reciprocal path of the designator laser and representative of the space-time position of the controlled deliverable to be focused as a controlled deliverable spot on the mosaic array sensor and to calculate a command guidance signal in response to the controlled deliverable spot that represents that maneuver that the controlled deliverable needs to execute to remain on its intended trajectory, and (4) to transmit the same to the controlled deliverable for execution. To provide tracking and command guidance of the controlled deliverable and in the second operational mode where the target is in motion or otherwise where it is desirable to have real-time knowledge of actual target location, the processor 136 performs the same functions as above, together with the supplementing function to (1), above, to controllably steer the field of view of the tracker 102 such that the intended target location is sighted by its field of view, with the further function, supplementing (2), above, to activate the designator laser 128 and steering mirrors of the optical tracker 102 and concomitantly to so synchronize the laser separator that the optical path of the designator laser is caused to illuminate the intended target location, with the further function, supplementing (3), above, to synchronize the laser separator to allow return energy present along the reciprocal path of the designator laser and representative of the space-time position of the intended target, whether static or mobile, to be focused as a target spot on the mosaic array sensor and to calculate a command guidance signal, in response to both the controlled deliverable spot and to the target spot, representative of the maneuver that the controlled deliverable needs to execute to conform its trajectory to its intended trajectory so as to impact the target at the target location, and, as in 4., above, to transmit the same for execution by the controlled deliverable. In connection with the first three functions, in both the first and second modes, reference may be had to the above-identified and incorporated cognate U.S. utility patent application Ser. No. 927,266 and filed Nov. 4, 1986, together with utility patent application Ser. No. 517, 147, and filed May 1, 1990 of the same title, which latter application now includes the subject matte of the former, which former application is now abandoned, and U.S. utility patent 4,776,691 filed as. U.S. utility patent application Ser. No. 791,757 on Oct. 28, 1985 and entitled: COMBINATION LASER DESIGNATOR AND BORESIGHTER SYSTEM FOR A HIGH-ENERGY LASER, each incorporated herein by reference.

Figure 2B:
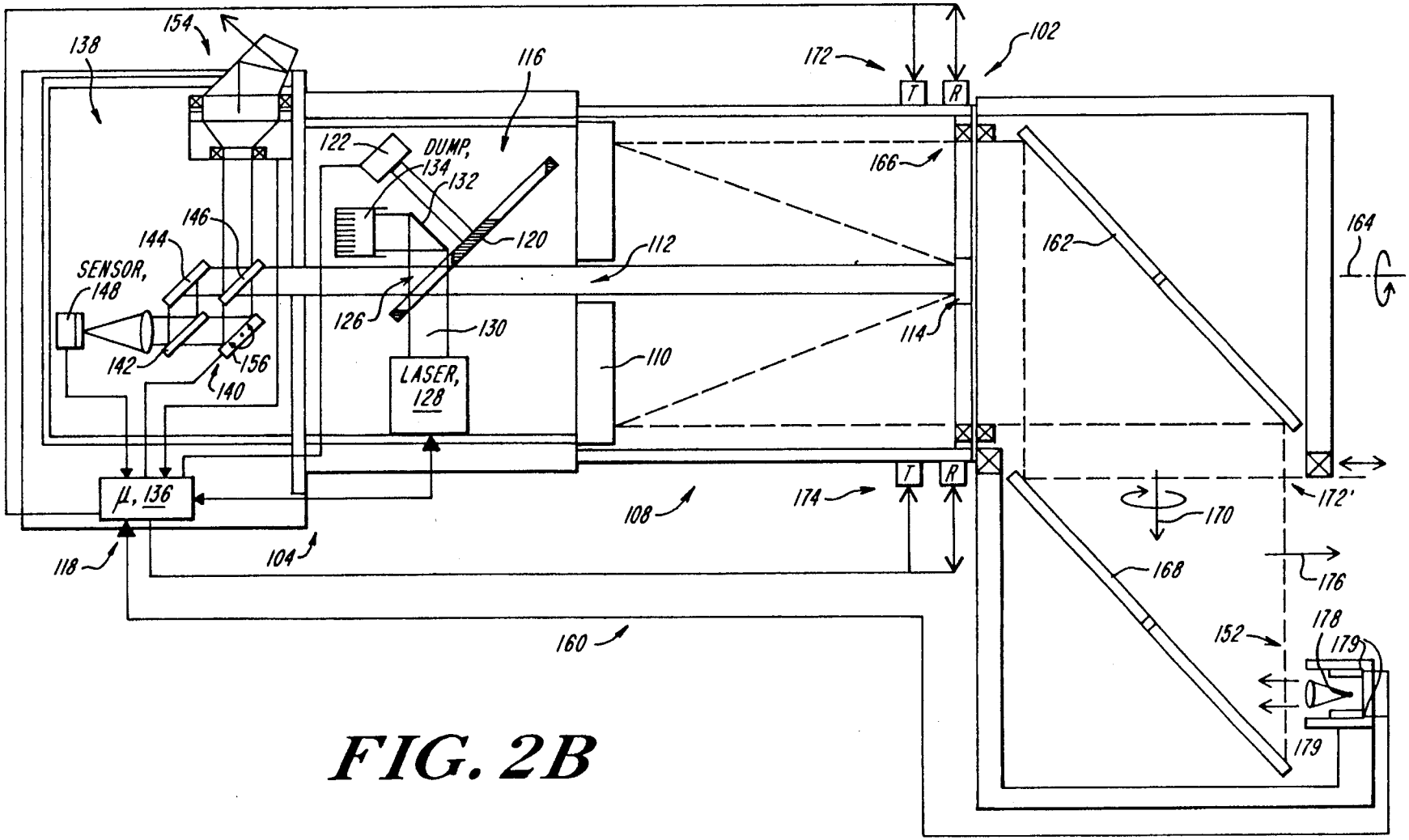

Referring now to FIG. 2B, generally designated at 160 is an alternative embodiment of the space-based command guidance controller 12 (FIG. 1A) in accord with the ballistic missile remote targeting system and method of the present invention. The embodiment 160 of FIG. 2B is generally similar to the embodiment 100 of FIG. 2A except that the optical tracker 102, instead of having the two degree of freedom mirror 106 (FIG. 2A), includes a first mirror 162 controllably rotatable about an axis 164 as by rotary bearings generally designated 166, and a spaced-apart second mirror 168 confronting the mirror 162 and rotatable about an axis 170 that is orthogonal to the axis 164 as by rotary bearings generally designated 172'. The first and second mirrors 162 and 168 are cooperative to provide the optical tracker 102 of the FIG. 2B embodiment of the space-based command guidance controller 160 with a wide field of regard pointing and tracking capability by which its line-of-sight is fully steerable about the two orthogonal axes 164,170 as by torquers and resolvers generally designated 172,174 coupled to the processor 136.

The embodiment 160 of FIG. 2B also differs from the embodiment 100 of FIG. 2A in the respect that unlike the placement of the inertial platform 152 in physical proximity to the monolithic optics 140 with its optical axis in generally parallel relation to the line of sight of the specular member 106 in FIG. 2A, the inertial platform 152 in the embodiment 160 of FIG. 2B is positioned in physical proximity with the second mirror 168 of the optical tracker 102 with its optical axis in parallel relationship to the line of sight illustrated by arrow 176 of the optical tracker 102 for all directions within the wide field of regard of the optical tracker 102. As in the embodiment 100 of FIG. 2A, the placement of the optical axis in parallel relation with the line-of-sight of the optical tracker 102 ensures maximum sensitivity of the inertial platform 152, whether it is magnetically suspended, or whether it is suspended by gimbals, by spring joints or by other suspension means known to those skilled in the art.

The embodiment 160 of FIG. 2B differs from the embodiment 100 of FIG. 2A in the further respect that instead of the alignment laser 150 being positioned in spaced-apart relation to the inertial platform 152 as in the embodiment of the FIG. 2A, it is mounted directly to the inertially-stabilized member of the inertial platform 152 as illustrated at 178 in FIG. 2B. High-bandwidth low-amplitude noise compensation is implemented in the FIG. 2B embodiment in the same manner as in the FIG. 2A embodiment, the sole difference being that the alignment laser beam traverses a different optical path through an optical train constituted by the elements 168, 162, 110, 114, 126, 146, 144 and 142 to the mosaic array sensor 148.

The inertial platform 152 having the alignment laser 178 mounted to its platform at rest with respect to inertial space is mounted for motion with the optical tracker 102. Gap sensors 179 responsive to the distance defined between the housing and stabilized platform of the inertial platform 152, 179 are coupled, as illustrated, to the processor 136. Any low-bandwidth, high-amplitude motion of the optical tracker 102 occasioned by noise or other phenomena manifests as a change in the position of the stabilized platform to which the alignment laser 178 is mounted relative to the housing thereof. The gap sensors 179 provide a signal to the processor 136 representative of any such change. The processor 136 is responsive to the gap sensor signal to so drive the torquers and resolvers 172,174 as to null the measured distance change and therewith compensates the tracker 102 for the disturbances occasioned by the low-bandwidth high-amplitude noise source or sources.

The beam 130 of the designator laser 128 is positioned in the compressed region of the beam expander and compressor 108 of the optical tracker 102 of both of the embodiments 100 and 160 of the FIGS. 2A and 2B, and the mosaic sensor 148 and processor 136 of the embodiment 160 enjoys the same high-resolution spot position determination capability that follows from the magnification factor of the beam expander and compressor as that of the embodiment 100 of the FIG. 2A.

A further advantage follows from the magnification provided by the beam expander and compressor 108 of the optical tracker 102 of the embodiments 100 and 160 of the FIGS. 2A and 2B. For both embodiments, the beam expander is responsive to the beam 130 and expands the aperture of the designator laser 128. Insofar as the degree of spread that the coherent designator laser exhibits as it traverses its optical path is inversely related to its aperture size, the expanded aperture of the designator beam that uses the full expanded aperture of the beam expander and compressor 108 of the corresponding tracker 102 provides comparatively less beam spread than would the unexpanded aperture of the beam 130 of the designator laser 128 if it were directed towards the target without prior expansion.

Figure 2C:
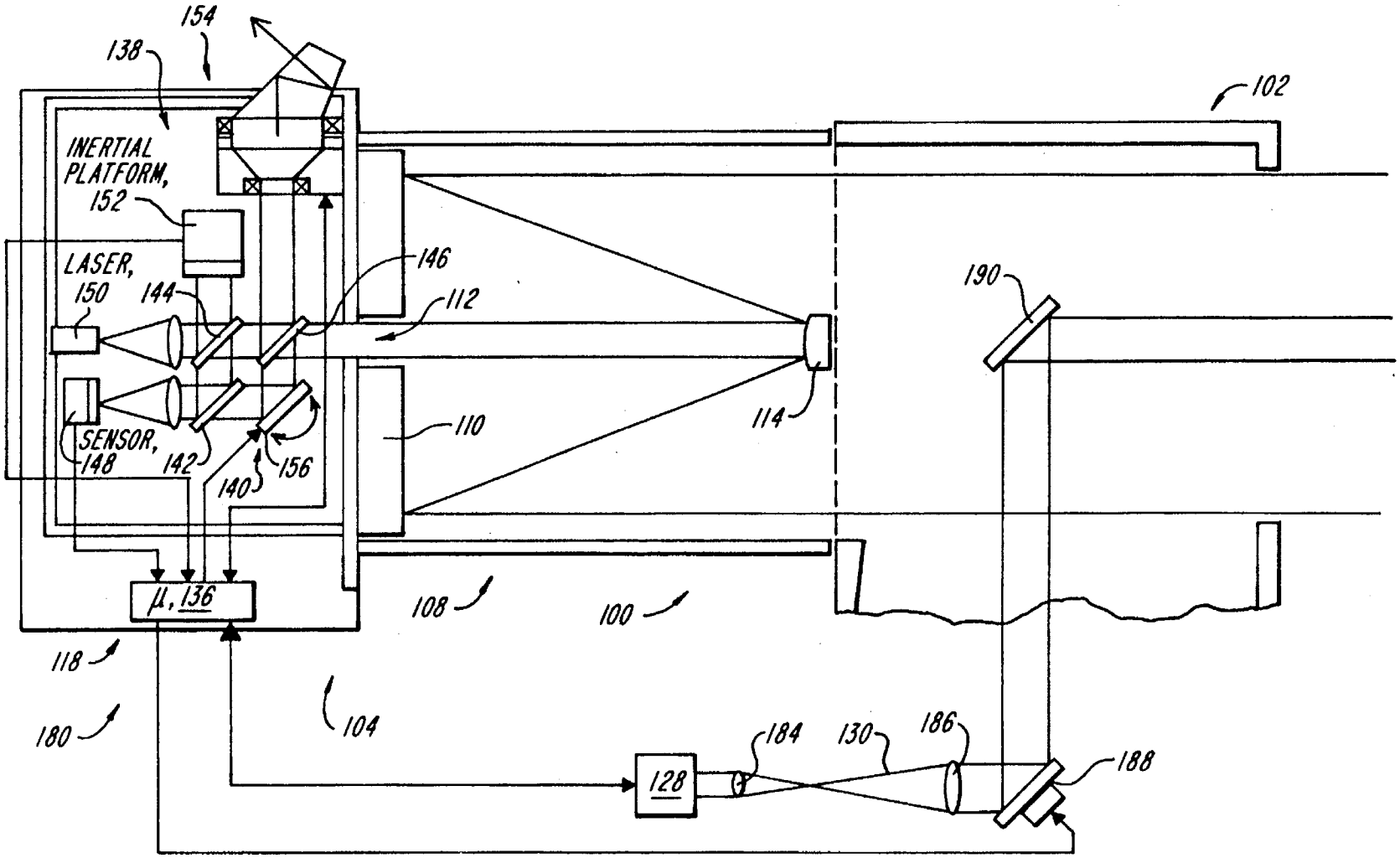

Referring now to FIG. 2C, generally designated at 180 is a further embodiment of the space-based command guidance controller 12 (FIG. 1A) in accord with the ballistic missile remote targeting system and method of the present invention. The embodiment 180 differs from the embodiments 100 and 160 of the FIGS. 2A and 2B in the sole respect that the designator laser 128 is positioned in the expanded region of the beam expander 108 of the tracker 102 rather than in the compressed region of the beam expander 108 as in the embodiments 100 and 160 of the FIGS. 2A and 2B. The designator laser may be remotely located either at an earth station or at a spatially separated space-platform, by way of examples, without departing from the inventive concept.

In the embodiment 180 of FIG. 2C, the designator laser 128 is optically coupled to the expanded region of the beam compressor and expander 108 of the tracker 102 via cooperative focusing lenses 184, 186, two-degree of freedom actuator 188, and a reflective member 190 positioned along the optical axis of the beam expander 108. The optical aperture of the reflective member 190 is selected to be less than the optical aperture of the expanded region of the beam expander 108 by a factor that enables both reception and projection of optical energy along a common reciprocal optical path. The beam 130 of the designator laser 128 is focused and collimated by the lenses 184, 186 and is controllably deviated by the steerable mirror 188 onto the reflector 190. The reflector 190, in turn, deviates it about the optical axis of the beam expander 108. The steerable mirror 188 is controllably angled by the processor 136 of the inertially-stabilized tracker 138 to cause it, upon deviation by the reflector 190, to conform to the space-time trajectory with respect to inertial space that the controlled deliverable is to locally follow to the target location. During the boresight mode, the steerable mirror is controllably angled by the processor 136 of the inertial tracker 138 to cause the coherent designator beam, upon deviation off of the reflector 190, to illuminate the actual target location.

Figure 3A:
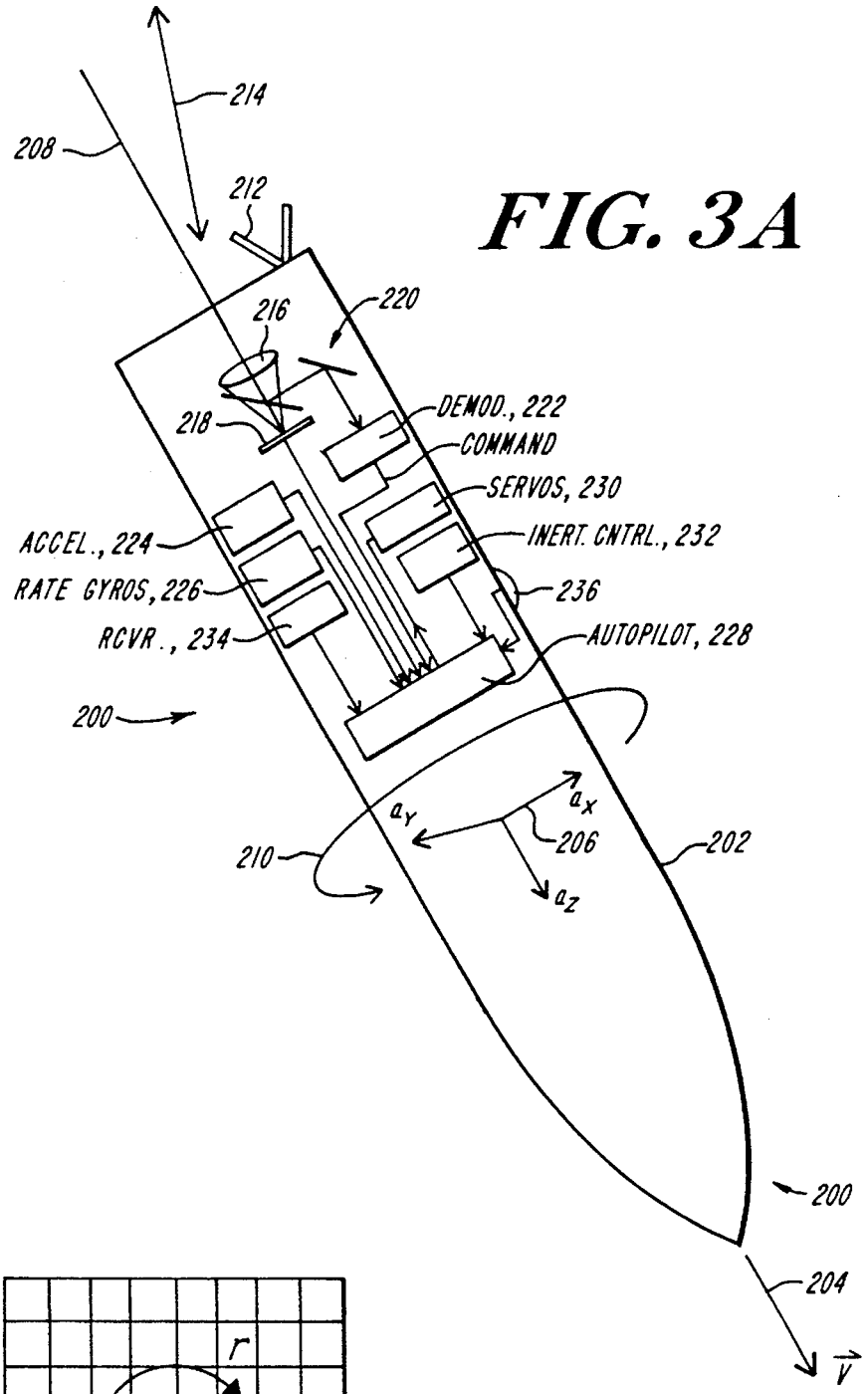
FIG. 3 illustrates in the FIG. 3A thereof a schematic diagram and in the FIG. 3B thereof a sensor plane diagram useful in explaining the operation of the substantially scale-factor-error-free roll sensor of the controlled deliverable in accord with the ballistic missile remote targeting system and method of the present invention.

Referring now to FIG. 3, generally designated at 200 in FIG. 3A is a pictorial diagram illustrating a controlled deliverable in accordance with the ballistic missile remote targeting system and method of the present invention. The controlled deliverable 200 has a vehicle body 202. The vehicle body 202 in motion defines a velocity vector illustrated by arrow 204 designated "V" and defines acceleration vectors about three orthogonal axes 206 designated "$A_y$", "$A_x$", and "$A_z$". As appears more fully below, the body 202 of the controlled deliverable 200 during reentry into the atmosphere describes a complex motion. Traveling at speeds of about Mach five, it executes a rolling motion about its long axis 208 as schematically illustrated by arrow 210. As the controlled deliverable 200 rolls, typically at a two revolution per second rate, the body 202 undergoes frictional heating and surface ablation. Unbalanced forces and corresponding accelerations are thereby produced and the body 202 of the controlled deliverable 200 experiences asymmetric accelerations in X, Y, and Z. The body 202 in free-fall correspondingly exhibits a complex pitching, yawing and rolling motion.

To the body 202 of the controlled deliverable 200 a corner cube reflector 212 is mounted. The reflector 212 or other signal returning or vehicle identifying means is mounted to the rear of the body 202 in position to intercept the designator beam of coherent optical energy and to deviate the same as a reflection signal reciprocally back along the same optical path to the space-based command guidance controller as schematically illustrated by double-headed arrow 214. The reflection signal is representative of the spatial-temporal location of the body 202 of the controlled deliverable 200.

Optics schematically illustrated by lens 216 are positioned to intercept the designator beam 214 on the body 202 of the controlled deliverable 200. The optics 216 defines a focal plane, and a mosaic sensor 218 or other sensing means is positioned in the focal plane of the optics 216. The designator beam spot centroid is measured as well as any signal modulation that can be split off to a demodulator 222. Accelerometers 224 and rate gyros 226 are mounted to the body 202 of the controlled deliverable 200 and respectively provide real-time signal indications of the lateral accelerations in X and in Y and of the pitch rate and of the yaw rate of the body 202 of the controlled deliverable 200, respectively.

An autopilot 228 to be described is coupled to the output of the mosaic sensor 218 and to the output of the demodulator 222, accelerometers 224 and the rate gyros 226. Maneuvering control servos 230, such as gas jets, inertially controllable movable weights, and aerodynamic control surfaces, among others, are mounted to the body 202 of the controlled deliverable 200 and connected to the output of the autopilot 228. An inertial guidance subsystem 232 is coupled to the autopilot 228 to enable the same to control itself during operation in an inertial guidance mode. A receiver 234 is coupled to the autopilot 228 to enable the autopilot to respond to the command guidance signal in the embodiment where the command guidance signal is not modulated on the coherent designator laser but is transmitted by way of a transmitter on-board the space-based command guidance controller. A homing sensor 236 of any suitable type may be connected to the autopilot 228.

As appears more fully hereinbelow, the autopilot 228 is responsive to the command guidance signal as provided by the space-based command guidance controller that is representative of the maneuver that the controlled deliverable is to execute to enable it to conform to its intended trajectory including to conform to its intended impact point during the terminal phase thereof and is responsive to signals to be described provided by the controlled deliverable representative of the real-time attitude in pitch, yaw, and roll of the body of the controlled deliverable to actuate the servos 230 to cause the controlled deliverable 200 to follow the beam path of the coherent designator beam at each phase of its trajectory from launch until it is delivered to the intended target location.

Figure 3B:
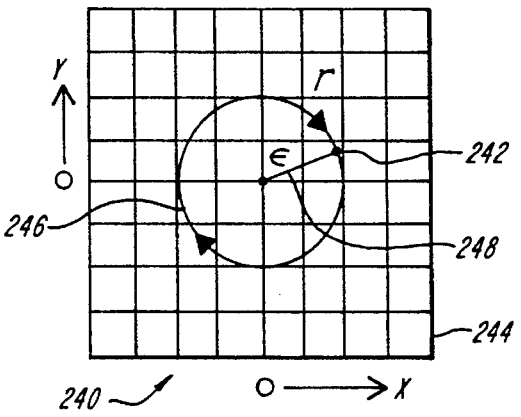

Referring now to FIG. 3B, generally designated at 240 is a sensor diagram useful in explaining the operation of the substantially scale-factor-error-free roll sensor of the controlled deliverable in accord with the ballistic missile remote targeting system and method of the present invention. During atmospheric reentry, the body 202 (FIG. 3A) of the controlled deliverable 200 (FIG. 3B) experiences a complex pitching, yawing, and rolling motion as it spirals down through the atmosphere toward the target location. The optics 216 (FIG. 3A) focuses the designator beam 214 (FIG. 3A) as a spot 242 on the focal plane of the mosaic array sensor 244. As the body of the vehicle moves with respect to the designator beam 214 (FIG. 3A), the spot 244 traces a pattern on the focal plane of the mosaic array sensor 244 that corresponds to the pattern of motion of the controlled deliverable. For example, if the controlled deliverable were experiencing a pure rolling motion about its long axis, the motion of the spot 242 corresponding thereto would appear as a circle pattern 246 having a radius 248 having a magnitude designated "ε". The magnitude of the radius "ε" for this example corresponds to the angle that the designator beam 214 (FIG. 3A) makes with the long axis 208 (FIG. 3A) of the controlled deliverable 200 (FIG. 3A), and the angular frequency designated "v" with which the spot 242 traces out the circular pattern 246 corresponds to the roll rate of the controlled deliverable 200. Unlike the heretofore known gyroscopic roll sensors subject to scale-factor error, the roll rate "v" of the controlled deliverable provided by the mosaic array roll sensor 218 (FIG. 3A) is substantially free from scale-factor error.

To each pattern of motion that describes the actual trajectory of the controlled deliverable as it descends, the designator spot on the focal plane of the mosaic array roll sensor traces out a corresponding pattern. The output of the mosaic array roll sensor 218 together with the output of the lateral accelerometers and pitch and yaw gyros enables the autopilot 228 (FIG. 3A) to execute the command guidance signal supplied thereto by the space-based command guidance controller whereby it is caused to follow its trajectory to the target location. The mosaic array sensor 218 (FIG. 3A) preferably is the sensor described and claimed in the above-incorporated cognate U.S. Patent, although any other suitable optical or other sensors may as well be employed without departing from the inventive concept.

The controlled deliverable in accord with the ballistic missile remote targeting system and method of the present invention is operable in a selectable one or more of plural modes. A first mode is an inertial control mode during which it is entirely guided by the on-board inertial control subsystem; this mode may be useful, for example, during the first atmospheric leg and during the space-leg of its trajectory. A second mode is the command guidance mode during which it is always maintained on course by executing the maneuvers remotely provided thereto by the space-based command guidance controller; this mode may be useful, for example, during the second atmospheric leg. A third mode is homing control, where the controlled deliverable itself homes in, via its homing sensor, on the target by closing on an image of the target that is produced in real-time in response to the illumination of the target by the designator laser carried and controllably pointed by the space-based command guidance controller in the target boresight mode. The third mode may be useful, for example, just prior to impact of the target location by the controlled deliverable.

In the preferred embodiment the command guidance signal is an acceleration command guidance signal that is representative of the lateral acceleration that the controlled deliverable is to execute to remain on-course towards the target location and to impact the same during the final phase of its trajectory.

Figure 4:
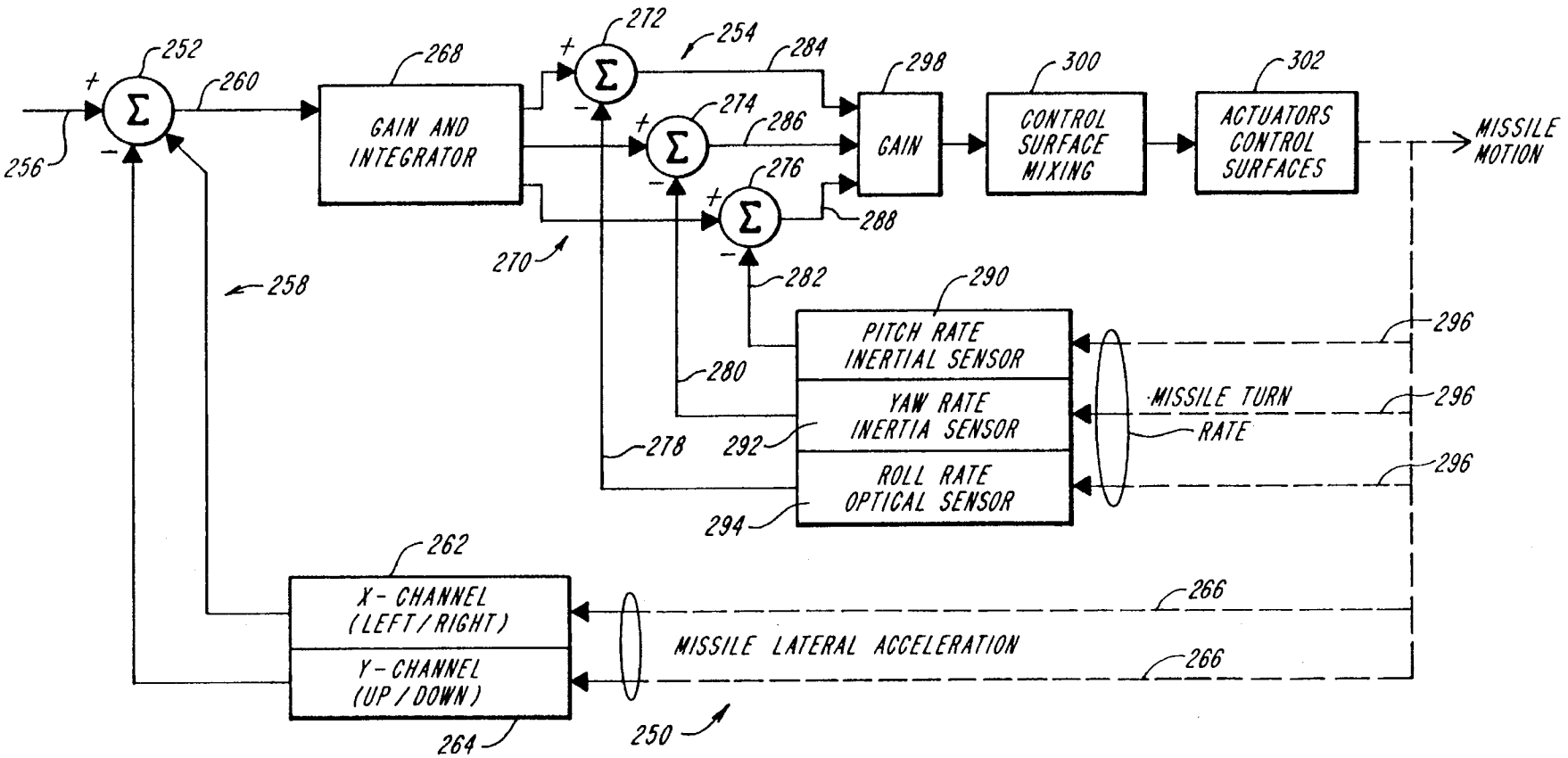
FIG. 4 is a control diagram illustrating an autopilot of the controlled deliverable in accord with the ballistic missile remote targeting system and method of the present invention.

Referring now to FIG. 4, generally designated at 250 is a functional diagram of the autopilot of the controlled deliverable in accord with the ballistic missile remote targeting system and method of the present invention. The autopilot 250 includes an acceleration control node having a summer 252 and an attitude control node having a summer network generally designated 254. The acceleration control node 252 is responsive to a command guidance signal 256 representative of the lateral acceleration that the controlled deliverable is to execute to remain locally along its intended trajectory and to a vehicle acceleration composite signal generally designated 258 representative of the actual lateral acceleration in X and in Y of the controlled deliverable to provide an acceleration error signal 260 representative of the deviation in lateral acceleration of the controlled deliverable off its intended trajectory.

The signal 256 representative of the lateral acceleration that the controlled deliverable is to execute to remain locally along its intended trajectory may be provided by different sources in conformance with its corresponding operational mode. During operation in the inertial guidance mode, the signal 256 is provided by the inertial guidance subsystem on-board the controlled deliverable. During operation in the command guidance mode, the signal 256 is provided by the processor of the space-based command guidance controller. In the embodiment where the designator beam is itself modulated with the command guidance signal, the demodulator 222 (FIG. 3A) demodulates the designator beam 214 (FIG. 3A) modulation content, and in the embodiment where a separate transmitter 26 (FIG. 1) provides the command guidance signal, the receiver 50 (FIG. 1) outputs the signal 256 to the node 252. During operation in the homing mode, the signal 256 is provided by the autopilot 228 (FIG. 3A) from the homing sensor 236 of FIG. 3A. For each of the several modes, the signal 258 representative of the actual acceleration of the controlled deliverable is provided by X,Y accelerometers 262,264 respectively in response to the real-time "left/right" and "up/down" accelerations of the controlled deliverable as schematically illustrated by dashed lines 266. Any suitable, preferably compact X,Y accelerometers, such as quartz resonant accelerometers or others, may be employed. A conventional gyro to measure the roll may be provided should cloud-cover be a problem.

A gain and integrator 268 is responsive to the acceleration error signal 260 output by the summer 252 of the acceleration command node to provide a second error signal generally designated 270 representative of the intended position and attitude of the controlled deliverable along its intended trajectory.

The summer network 254 includes three nodes 272, 274, 276 that are individually responsive to the error signal 270 representative of the intended position and attitude of the controlled deliverable along its intended trajectory and to signals 278, 280, 282 respectively representative of the actual position and altitude of the controlled deliverable in roll, yaw and pitch to provide second error signals 284, 286, 288 respectively representative of the local deviation with respect to position and attitude of the controlled deliverable from its intended trajectory.

The signals 278, 280, 282, representative of the actual attitude of the controlled deliverable, are respectively provided by a pitch rate inertial sensor 290, a yaw rate inertial sensor 292 and a roll rate optical sensor 294 each mounted to the body 202 (FIG. 3A) of the controlled deliverable. The pitch rate and yaw rate sensors 290, 292 correspond to the rate gyros 226 (FIG. 3A), and the roll rate optical sensor 294 corresponds to the substantially scale-factor-error-free mosaic array roll sensor 218 (FIG. 3A), 244 (FIG. 3B). The sensors 290, 292, 294 are responsive to the actual pitch, yaw and roll of the command deliverable as schematically illustrated by dashed lines 296. The pitch rate inertial sensor 290 and the yaw rate inertial sensor 292 are preferably compact, limited-amplitude, modest accuracy gyros, such as micromechanical gyros, or others, although any other suitable pitch rate and yaw rate sensors may be employed.

The error signals 284, 286, 288 representative of the local deviation of the controlled deliverable from intended attitude and position are fed through a gain stage 298 to a control surface mixing stage 300 of the autopilot. The control surface mixing stage 300 is responsive to the amplified error signals and controllably actuates the controlled deliverable's servos illustrated by the box 302 labelled "actuators control surfaces" to drive the error to zero. Therewith, the controlled deliverable is caused to so accelerate in accord with the command guidance signal as to locally conform to its intended trajectory and thus to the target location.

In operation in the command guidance mode, the space-based command guidance controller and controlled deliverable are so cooperative that the processor of the inertially-stabilized tracker of the space-based command guidance controller controllably steers the steerable field of view of the optical tracker in such a way that the controlled deliverable is sighted and is tracked within the field of view of the optical tracker and designator laser subassembly. The processor of the inertially-stabilized tracker calculates an intended trajectory that the controlled deliverable is to follow towards the target location, and controllably actuates the designator laser and steering mirrors of the optical tracker to project a designator laser beam along an optical path defined with respect to inertial space that traverses the intended trajectory that the controlled deliverable is to follow towards the target location. The calculation of the trajectory is parametrized by the coordinates of the target location in well-known manner, which coordinates may be based on real-time data representative of the target, as provided by the target spot on the mosaic array sensor in the boresight mode, and/or based on pre-stored and/or calculated data representative of the target location. The corner cube or other reflecting means on the controlled deliverable returns a portion of the designator laser beam back to the inertially-stabilized tracker on-board the space-based command guidance controller along an optical path that is reciprocal to the optical path of the beam of the coherent designator laser. The reciprocity of the optical paths of outgoing and return optical energy ensures that any atmospheric-induced medium-associated distortions are self-compensating. Reference in this connection may be had to commonly-assigned U.S. Pat. No. 4,571,076, entitled: "BLOOMING AUTO COLLIMATOR", of the same inventive entity as herein, incorporated herein by reference, for a description of the manner by which reciprocal optical paths enable to provide self-canceling medium-induced disturbances.

The optical energy that is returned back to the space-based command guidance controller along an optical path that is reciprocal to the optical path of the coherent designator laser beam is imaged as a spot on the focal plane of the high-bandwidth mosaic array sensor of the inertially-stabilized tracker thereof. The controlled deliverable spot is noise-compensated and star-updated in the manner described for the target spot and beacon spots in the above-identified cognate United States utility patent applications, so that its position thereon is representative of the space-time coordinates of the controlled deliverable with respect to inertial space.

The processor of the inertially-stabilized tracker is responsive to the position of the controlled deliverable spot to calculate any deviation of the controlled deliverable locally from its intended trajectory and to calculate based on any such deviation a command guidance signal that represents that vehicle lateral acceleration that upon its execution is to maneuver the controlled deliverable into local conformance with the beam path of the coherent designator beam. During operation in the boresight mode, such as during the final phase of its trajectory, the lateral acceleration represented by the command guidance signal is calculated by the processor of the inertially-stabilized tracker in response to both the position of the controlled deliverable spot and the target spot on the high-bandwidth mosaic array sensor. For each of the embodiments of the FIG. 2 space-based command guidance controller, the execution of the command guidance signal by the controlled deliverable at corresponding phases of its trajectory thereby insures that the controlled deliverable is delivered to the target location and into the target thereat, with surgical-like precision.

In the embodiment of FIG. 2A, the processor is operative to so point the designator laser beam that it defines the trajectory that the controlled deliverable is to locally follow to the intended target location as well as defines the line of sight to the intended target location by appropriately angling the two degree of freedom specular member in the expanded region of the optical tracker; in the embodiment of FIG. 2B, the processor accomplishes the same functions by appropriately angling the two cooperative mirror members via the corresponding torquers and resolvers of the optical tracker in the expanded regions of the beam expander, and in the embodiment of FIG. 2C, the processor controllably points the coherent designator laser by appropriately angling the two-degree of freedom specular member located in the expanded region of the beam expander and contractor of the optical tracker to implement the same functions. In each of the embodiments of the FIGS. 2A, 2B and 2C, the position and trajectory of the space-based command guidance controller, intended target location and the controlled deliverable are calculated by the processor of the inertially-stabilized tracker thereof, that of the space-based command guidance platform and intended target location on the basis of ground tracking, star updates and orbital navigation equipment and that of the controlled deliverable on the basis of the pattern of motion of the controlled deliverable spot on the high-bandwidth mosaic array sensor and range to the controlled deliverable. The processor is modally responsive to the calculated and measured positions and trajectories of the space-based command guidance controller and of the controlled deliverable, to the measured and calculated positions of the intended target location, and to the position of the fixed stars to calculate the intended trajectory that the controlled deliverable is to follow with respect to inertial space to impact the target location. The position of the fixed stars may alternatively be provided by the wide field of regard star tracker or by a controlled maneuver of the space-based command guidance controller as described above. In the embodiments of FIG. 2A and 2B, the processor of the inertially-stabilized tracker of the space-based command guidance controller so synchronizes the laser separator and designator laser that on the one hand the reflecting portion of the spinning mirror of the laser separator is aligned with the optical aperture of the laser separator while the designator laser is pulsed in an "on" condition, and that on the other hand the apertured portion of the spinning mirror of the laser separator is aligned with the optical aperture of the laser separator while the designator laser is pulsed in an "off" condition (or dumped to the power dump for CW operation) at times corresponding to the time it takes for the coherent designator laser to travel to and to be reflected back from the corner cube as well as to and from the intended target location along the respective one of the reciprocal optical paths through the apertured portion of the spinning mirror of the laser separator and into the corresponding inertially-stabilized tracker thereof. The monolithic optical assembly deviates the return energy onto the mosaic array sensor as controlled deliverable and target spots in the focal plane thereof, which spots are noise-compensated in the manner described in the above-identified cognate U.S. utility patent applications, and is not separately described herein for the sake of brevity of explication.

In both the FIGS. 2A and 2B embodiments, the processor of the inertially-stabilized tracker is modally responsive to the calculations representative of the intended trajectory of the designator laser beam and to the spots respectively representative of the actual position and trajectory of the controlled deliverable and of the intended target location to calculate the command guidance signal representative of that lateral acceleration that the controlled deliverable should execute to null any deviation from intended trajectory and thereby conform itself locally at each phase of its trajectory to its intended trajectory in either the boresight or the tracking modes.

In the embodiment of FIG. 2C, the optical aperture of the outgoing designator laser beam, that is a fraction of the aperture of the expanded region of the beam expander of the optical tracker, enables outgoing designator beam energy and return incoming energy reflected back either from the controlled deliverable or from the intended target to be present along the same reciprocal optical path for operation of the coherent designator laser in either the pulsed or the CW modes. The operation of the processor of the inertially-stabilized tracker in the FIG. 2C embodiment is otherwise identical to that of the processor of the inertially-stabilized tracker of the embodiment of FIGS. 2A and 2B and is not again described for the sake of brevity of explication.

Figure 5A:
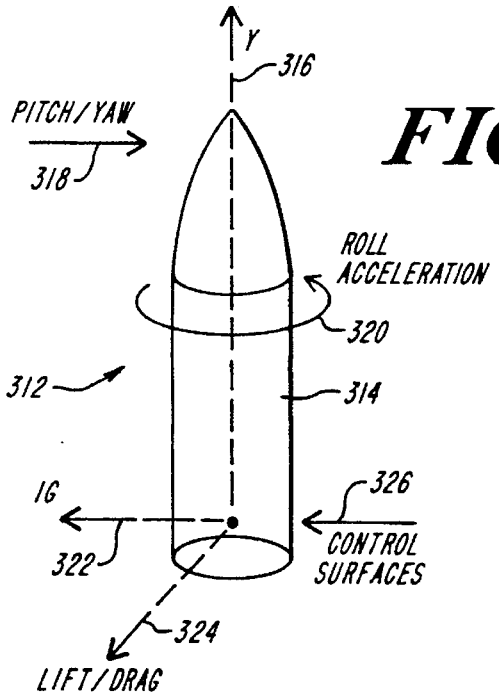
FIG. 5 illustrates in the FIG. 5A thereof a controlled deliverable free-body diagram, in the FIG. 5B thereof a pictorial diagram and in the FIG. 5C thereof a pictograph useful in explaining the manner by which the controlled deliverable executes an exemplary "2-G" command guidance signal in accord with the ballistic missile remote targeting system and method of the present invention.

Referring now to FIG. 5A, generally designated at 312 is a free body diagram useful in explaining the operation of the controlled deliverable in accord with the ballistic missile remote targeting system and method of the present invention. Acting on the body 314 of the controlled deliverable moving along its direction of elongation illustrated by an arrow 316 marked "Y" there is a first force illustrated by an arrow 318 marked "pitch/yaw" that is introduced by the pitching and yawing motion thereof, a second force illustrated by a curvilinear arrow 320 marked "roll acceleration" that is introduced by the uneven ablation of its nosecone, a third force schematically illustrated by a dashed arrow 322 marked "1G" that is introduced thereon by the earth's gravitational field, a fourth force schematically illustrated by a dashed arrow 324 marked "lift/drag" that is introduced by aerodynamic drag and lift, and a fifth force illustrated by an arrow 326 marked "control surfaces" that corresponds to the forces that the on-board servos may controllably give rise. The autopilot of the controlled deliverable so models these forces as to appropriately apply the lateral acceleration required as the body of the controlled deliverable pitches, rolls, and yaws about to maneuver the controlled deliverable into accord with the trajectory specified therefor by the command guidance signal.

Figure 5B:
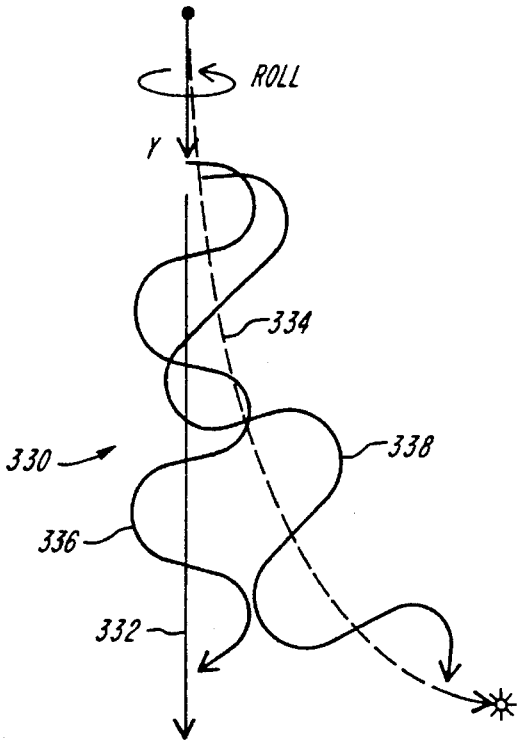
Figure 5C:
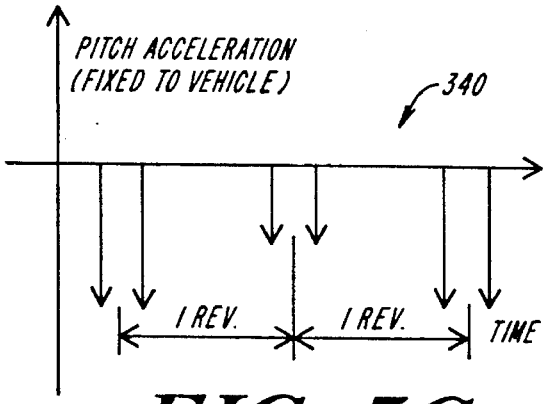

Referring now to FIG. 5B, generally designated at 330 is a pictograph that is useful in illustrating how the autopilot 228 (FIG. 34) operates to implement an exemplary "2-G" lateral turn command guidance signal during the atmospheric reentry phase of its guided trajectory. The actual trajectory of the controlled deliverable is represented by a line 332, the intended trajectory by a dashed line 334 defined as a "2-G" acceleration perpendicular to the direction of velocity of the actual trajectory 332, and the attitudes of the controlled deliverable in pitch, roll and yaw locally along the trajectories 332, 334 is represented by the curvilinear lines 336, 338 respectively. The autopilot of the controlled deliverable is responsive to the "2-G" command guidance signal, to the output of the pitch, roll and yaw sensors and to the output of the X, Y lateral accelerometers to activate the servo's as the controlled deliverable is moving in the complex roll, pitch and yaw pattern illustrated by the curvilinear paths 336, 338 to implement the lateral "2-G" command guidance signal. As generally designated at 340 in FIG. 5C, for an exemplary two (2) revolutions per second roll rate, the autopilot actuates the servos at periodic times corresponding to the two (2) rev/sec roll rate.

Many modifications of the, presently disclosed invention will become apparent to those skilled in the art without departing from the inventive concept.

What is claimed is:

1. Space-based command guidance controller apparatus and a controlled deliverable traveling at speeds of about Mach five that are cooperative to cause the controlled deliverable to follow a coherent designator beam controlled by the space-based command guidance controller towards a target location designated by the beam along an over-the-horizon trajectory, comprising:

space-based command guidance controller first means for controllably pointing a coherent designator beam along an optical path defined with respect to inertial space that corresponds to the trajectory that the controlled deliverable is to follow;

space-based command guidance controller second means cooperative with the first means and responsive to optical energy present along the reciprocal optical path of the coherent designator beam for providing a signal representative of where the controlled deliverable is with respect to the optical path of the coherent designator beam;

space-based command guidance controller third means cooperative with the first and second means and responsive to the signal representative of where the controlled deliverable is with respect to the optical path of the coherent designator beam for providing a command guidance signal representative of what maneuver the controlled deliverable needs to execute to conform its trajectory to the optical path of the coherent designator beam;

controlled deliverable fourth-means for providing a signal representative of the real-time attitude of the controlled deliverable in pitch, in yaw and in roll; and controlled deliverable fifth means cooperative with the fourth means and responsive to the signal representative of the real-time attitude of the controlled deliverable in pitch, roll, and in yaw and responsive to the command guidance signal for executing the command guidance signal at that phase in pitch, roll and yaw that allows the controlled deliverable to conform its trajectory to the beam path of the coherent designator beam and thereby to deliver itself to a target at the target location with surgical-like precision.

2. The invention of claim 1, wherein said first and second cooperative means include a coherent designator laser and inertially-stabilized tracker assembly, and an optical tracker having a steerable field of view.

3. The invention of claim 2, wherein said first and second cooperative means further include a wide field of regard star tracker.

4. The invention of claim 2, wherein the inertially-stabilized tracker includes a processor for calculating said optical path of the coherent designator beam with respect to inertial space.

5. The invention of claim 3, wherein said inertially-stabilized tracker includes a processor and gyros subject to errors due to the phenomenon of gyro drift, and wherein said wide field of regard star tracker is cooperative with said processor to compensate the gyros for drift.

6. The invention of claim 1, wherein a reflector is mounted to the controlled deliverable from which the coherent designator beam is reflected back to the space-based command guidance controller, and wherein said first and second cooperative means include an inertially-stabilized tracker responsive to the reflected back designator beam to provide said signal representative of where the controlled deliverable is with respect to the optical path of the coherent designator beam.

7. The invention of claim 6, wherein the inertially-stabilized tracker includes a high-bandwidth mosaic array sensor, and the signal representative of where the controlled deliverable is with respect to the optical path of the coherent designator laser is constituted as a spot on the high-bandwidth mosaic array sensor.

8. The invention of claim 7, further including means coupled to the high-bandwidth sensor for compensating the signal representative of where the controlled deliverable is with respect to the optical path of the coherent designator laser for space and other sources of noise vibration to which the inertially-stabilized tracker is subject.

9. The invention of claim 8, wherein said noise compensation means includes a platform at rest with respect to inertial space.

10. The invention of claim 9, wherein said platform at rest with respect to inertial space includes a magnetically suspended platform defining an axis.

11. The invention of claim 9, wherein the platform defines an axis of stability, wherein said first and second cooperative means includes an optical tracker having a pointing direction, and wherein said axis is in generally parallel relation with the pointing direction of the optical tracker.

12. The invention of claim 9, wherein said platform at rest with respect to inertial space includes a gimbaled platform defining an axis of stability.

13. The invention of claim 12, wherein said first and second cooperative means include an optical tracker having a pointing direction, and wherein said axis of stability is orientated in generally parallel relation with the pointing direction of the optical tracker.

14. The invention of claim 2, wherein said optical tracker includes a beam expander and compressor.

15. The invention of claim 14, wherein said designator laser is positioned in the compressed region of said beam expander and compressor.

16. The invention of claim 14, wherein said designator laser is positioned in the expanded region of said beam expander and compressor.

17. The invention of claim 16, wherein said designator laser positioned in the expanded region is remotely positioned to the space-based command guidance controller.

18. The invention of claim 14, wherein said inertially-stabilized tracker includes a high-bandwidth sensor having a multiple-spot tracking capability, said beam expander and compressor provides a preselected magnification factor that enhances positional resolution of spots on the high-bandwidth mosaic array sensor as well as minimizes the spread of the coherent designator beam.

19. The invention of claim 2, wherein said optical tracker includes a two degree of freedom specular member.

20. The invention of claim 2, wherein said optical tracker includes two confronting and spaced apart specular members rotatable about orthogonal axes.

21. The invention of claim 1, wherein said command guidance signal representative of what maneuver the controlled deliverable needs to execute to conform its trajectory to the optical path of the coherent designator beam is modulated on the coherent designator beam.

22. The invention of claim 1, wherein said command guidance signal representative of what maneuver the controlled deliverable needs to execute to conform its trajectory to the optical path of the coherent designator beam is separately transmitted by an electromagnetic transmitter operatively associated with the space-based command guidance controller.

23. The invention of claim 1, wherein said controlled deliverable fourth means includes pitch and yaw inertial sensors.

24. The invention of claim 1, wherein said controlled deliverable fourth means includes a substantially scale-factor-error-free roll sensor.

25. The invention of claim 24, wherein said substantially scale-factor-error-free roll sensor includes an optical sensor and associated optics responsive to the coherent designator beam to focus the same as an optical spot on the sensor that moves on the sensor in accord with the rolling motion of the controlled deliverable providing thereby a signal representative of the real-time attitude of the controlled deliverable in roll.

26. The invention of claim 1, wherein said controlled deliverable fifth means includes an autopilot and autopilot-controlled servos responsive to the command guidance signal and to the signals representative of the real-time attitude of the controlled deliverable in pitch, roll and yaw to so activate the servos that the controlled deliverable executes the command guidance signal.

27. The invention of claim 26, wherein said command guidance signal is an acceleration command guidance signal, and said autopilot is responsive to said acceleration command signal and to signals representative of real-time lateral acceleration of the controlled deliverable to actuate the servos to execute the command guidance signal.

28. A method for controlling a controlled deliverable traveling at speeds of about Mach five from a space-based command guidance controller to a target, comprising the steps of:

controllably directing a coherent optical beam from space along an optical path that both illuminates the controlled deliverable and defines the intended trajectory of the controlled deliverable;

sensing from space optical energy present along the reciprocal path of the coherent optical beam in such a way as to determine any deviation of the controlled deliverable locally from its intended trajectory; and sending from space a command guidance signal to the controlled deliverable representative of what vehicle maneuver it must execute locally along its actual trajectory to conform at each phase thereof to its intended trajectory.

29. The invention of claim 28, further including the step of executing the command guidance signal at the controlled deliverable.

30. The invention of claim 28, wherein said command guidance signal is an acceleration command guidance signal.

31. The invention of claim 28, wherein said sensing step includes the step of returning the coherent optical beam from the controlled deliverable to the space-based command guidance controller.

32. The invention of claim 31, wherein said returning step includes the step of positioning a reflector on the body of the controlled deliverable so as to deviate the coherent optical beam reciprocally back along the optical path thereof to the space-based command guidance controller.

33. The invention of claim 28, further including the step of sensing the real-time attitude of the controlled deliverable in pitch, roll, and in yaw.

34. The invention of claim 33, further including the step of executing the command guidance signal by taking into account the real-time attitude of the controlled deliverable in pitch, roll and yaw.

35. The invention of claim 33, wherein said roll sensing step includes the step of imaging the coherent optical beam as a spot at the controlled deliverable, and the step of responding to the motion of the image of the coherent optical beam at the controlled deliverable to calculate the real-time rolling motion of the controlled deliverable.

36. The invention of claim 28, further including the step of controllably directing the coherent optical beam from space along an optical path that illuminates the target; and wherein said sensing from space step includes the step of sensing optical energy present along the reciprocal path of the coherent optical beam that illuminates the target in such a way as to determine any deviation of the controlled deliverable from the target.

37. Apparatus for controlling a controlled deliverable traveling at speeds of about Mach five to a target from a space-based command guidance controller, comprising:

means disposed on the space-based command guidance controller for controllably directing a coherent optical beam from space along a first optical path that both illuminates the controlled deliverable as well as defines the intended trajectory of the controlled deliverable and along a second optical path that illuminates the target;

means disposed on the space-based command guidance controller for sensing optical energy present along the reciprocal path of the first optical path of the coherent optical beam in such a way as to determine any deviation of the controlled deliverable locally from its intended trajectory and for sensing optical energy present along the reciprocal path of the second optical path in such a way as to determine the location of the target; and means disposed on the space-based command guidance controller responsive to the sensed optical energy along the reciprocal paths of the first and second optical paths for calculating and for sending a command guidance signal to the controlled deliverable representative of what vehicle maneuver it must execute locally along its actual trajectory to conform at each phase thereof to its intended trajectory so as to impact the target.

38. The invention of claim 37, wherein said controllably directing means includes means for controllably directing the coherent optical beam from space along an optical path that illuminates the target; and wherein said means for sensing optical energy present along the reciprocal path of the coherent optical beam so as to determine any deviation of the controlled deliverable locally from its intended trajectory includes means for sensing the position of the target from the reciprocal optical path of the coherent optical beam that illuminates the target.

39. Apparatus for controlling a controlled deliverable traveling at speeds of about Mach five to a target from a space-based command guidance controller, comprising:

means disposed on the space-based command guidance controller for controllably directing a coherent optical beam from space along an optical path that both illuminates the controlled deliverable as well as defines the intended trajectory of the controlled deliverable;

means disposed on the space-based command guidance controller for sensing optical energy present along the reciprocal path of the coherent optical beam in such a way as to determine any deviation of the controlled deliverable locally from its intended trajectory; and means for sending a command guidance signal to the controlled deliverable representative of what vehicle maneuver it must execute locally along its actual trajectory to conform at each phase thereof to its intended trajectory.

40. The invention of claims 37 or 39, further including means for executing the command guidance signal at the controlled deliverable.

41. The invention of claims 37 or 39, wherein said command guidance signal is an acceleration command guidance signal.

42. The invention of claims 37 or 39, wherein said sensing means cooperates with means disposed on the controlled deliverable for returning at least a portion of the coherent optical beam from the controlled deliverable to the space-based command guidance controller.

43. The invention of claim 37 or 39, wherein said returning means includes a reflector on the controlled deliverable in position to deviate the coherent optical beam reciprocally back along the optical path thereof to the space-based command guidance controller.

44. The invention of claims 37 or 39, further including means disposed at the controlled deliverable for sensing the real-time attitude of the controlled deliverable in pitch, roll, and in yaw.

45. The invention of claims 37 or 39, wherein said executing means in executing the command guidance signal takes into account the real-time attitude of the controlled deliverable in pitch, roll and yaw.

46. The invention of claims 37 or 39, wherein said sensing means cooperates with means disposed on the controlled deliverable for imaging the coherent optical beam as a spot at the controlled deliverable, and means responsive to the motion of the image of the coherent optical beam at the controlled deliverable to calculate the real-time rolling motion of the controlled deliverable.

47. Space-based command guidance controller apparatus and a controlled deliverable traveling at speeds of about Mach five that are cooperative to cause the controlled deliverable to follow a coherent designator beam controlled by the space-based command guidance controller towards a target location designated by the beam along an over-the-horizon trajectory, comprising:

space-based command guidance controller first means for controllably pointing a coherent designator beam along a first optical path defined with respect to inertial space that corresponds to the trajectory that the controlled deliverable should follow to the target location and for pointing the coherent designator laser along a second optical path so as to illuminate the target location;

space-based command guidance controller second means cooperative with the first means and responsive to optical energy present along the reciprocal optical paths of the first and second optical paths of the coherent designator beam respectively for providing a first signal representative of any deviation of the controlled deliverable from the trajectory that it should follow to the target location and a second signal representative of position of the target location; space-based command guidance controller third means cooperative with the first and second means and responsive to the first and second signals for providing a command guidance signal representative of what maneuver the controlled deliverable needs to execute to conform its trajectory to the trajectory that it should follow to the target location;

controlled deliverable fourth means for providing a signal representative of the real-time attitude of the controlled deliverable in pitch, in yaw and in roll; and controlled deliverable fifth means cooperative with the fourth means and responsive to the signal representative of the real-time attitude of the controlled deliverable in pitch, roll, and in yaw and responsive to the command guidance signal for executing the command guidance signal at that phase in pitch, roll and yaw that allows the controlled deliverable to conform its trajectory to the trajectory that it should follow and thereby to deliver itself to a target at the target location with surgical-like precision.

48. The invention of claim 47, wherein said target at said target location is a moving target.

49. The invention of claim 47, wherein said target at said target location is a static target.

50. The invention of claim 47, wherein a reflector is mounted to the controlled deliverable from which the coherent designator beam is reflected back to the space-based command guidance controller, and wherein said first and second cooperative means include an inertially-stabilized tracker responsive to the reflected back designator beam to provide said signal representative of any deviation of the controlled deliverable from the trajectory that it should follow to the target location.

51. The invention of claim 47, wherein said command guidance signal is modulated on the coherent designator beam.

52. The invention of claim 47, wherein said command guidance signal is separately transmitted by an electromagnetic transmitter operatively associated with the space-based command guidance controller.

53. The invention of claim 47, wherein said controlled deliverable fourth means includes a substantially scale-factor-error-free roll sensor.

54. The invention of claim 47, wherein said substantially scale-factor-error-free roll sensor includes an optical sensor and associated optics responsive to the coherent designator beam to focus the same as an optical spot on the sensor that moves on the sensor in accord with the rolling motion of the controlled deliverable providing thereby a signal representative of the real-time attitude of the controlled deliverable in roll.

* * * * *